US005307041A

United States Patent [19]

Kato et al.

[11] Patent Number: 5,307,041

[45] Date of Patent: Apr. 26, 1994

[54] COIL COMPONENT

[75] Inventors: Shigenori Kato; Norio Sato, both of Chiba, Japan

[73] Assignee: TDK Corporation, Japan

[21] Appl. No.: 911,042

[22] Filed: Jul. 9, 1992

[30] Foreign Application Priority Data

Jul. 16, 1991 [JP] Japan ..... 3-063449[U]

[51] Int. Cl.[5] ..... H01F 15/02; H01F 15/10

[52] U.S. Cl. ..... 336/83; 336/92; 336/192

[58] Field of Search ..... 336/83, 192, 65, 92, 336/90, 212

[56] References Cited

U.S. PATENT DOCUMENTS 4,623,865 11/1986 Kiesel et al. ..... 336/65
4,656,450 4/1987 Jarosz et al. ..... 336/192
4,888,571 12/1989 Kobayashi et al. ..... 336/83

FOREIGN PATENT DOCUMENTS 63-213211 9/1987 Japan .

*Primary Examiner*—Thomas J. Kozma

*Attorney, Agent, or Firm*—Banner, Birch, McKie & Beckett

[57] ABSTRACT

A coil component having a magnetic core together with a coil is precisely and correctly positioned on a printed circuit board by using an automatic mounting machine, which has a vacuum nozzle (6) for lifting the coil component, and a pair of adjusting chips (7,7) for finely adjusting the location of the coil component by pushing a wall of the coil component. The coil component comprises a dielectric support (insulator) (1), a plurality of terminal pins (2) molded in said support, each having a first end (2*a*) along a first side of the support for coupling with an end of a coil wound around a magnetic core, and a second end (2*b*) along a second side which is perpendicular to said first side for coupling with an external circuit on a printed circuit board. The coil component further comprises a rectangular housing (5) positioned on the support (1) through a projection (1*h*) on the support (1) and a recess (5*c*) which engages with the projection (1*h*) at the bottom of the housing (5) so that external wall (5*d*) of the housing (5) extends beyond said first end (2*a*) of the terminal pin (2). Thus, adjusting chips (7) adjusts the position of the coil component by pushing wall (5*d*) of the housing (5) where a soldered first end (2*a*) does not contact with adjusting chips (7).

10 Claims, 6 Drawing Sheets

COIL COMPONENT

BACKGROUND OF THE INVENTION

The present invention relates to a coil component, like an inductance coil, and/or a transformer, which is mounted on a printed circuit board through soldering; in particular, the invention relates to a coil component which is mounted automatically on a printed circuit board by using an automatic mounting machine which has a vacuum nozzle for holding a component.

A prior coil component, which is mounted on a printed circuit board, has a dielectric support on which are provided a magnetic core with a coil and a plurality of terminals projecting outward of the support. An end of a coil is engaged with a terminal which is then dipped into melted solder for soldering the end of the coil with the terminal. In this case, it should be noted that a small solder chip projects from the end of the terminal when the melted solder becomes solid. The length of the solder chip is not uniform.

An automatic mounting machine for mounting components on a printed circuit board has been used. In that machine, a component is attached on a vacuum nozzle, which is located by using a numerical control apparatus, and is placed on a desired location on a printed circuit board. The component is then fixed on the board through soldering. In this case, as the component must be located precisely and correctly on a desired location on a printed circuit board, the mounting machine adjusts the location of the component by using an adjusting chip which adjusts the location by pushing the component by the adjusting chip.

However, the prior coil component has a disadvantage in that a correct location, by an automatic mounting machine, is difficult because of said nonuniform small solder chips formed on the terminal pins. When an adjusting chip of an automatic mounting machine pushes the end of the terminals, each of which is covered with solder, the component is not located correctly because of the different lengths of the solder chips.

SUMMARY OF THE INVENTION

It is an object of the present invention to overcome the disadvantages and limitations of the prior coil component by providing a new and improved coil component.

It is also an object of the present invention to provide a coil component which is correctly and precisely located on a printed circuit board by using an automatic mounting machine.

The above and other objects are attained by a coil component comprising a dielectric support having a plurality of conductive terminal pins projecting from sides of said support; each of said terminal pins having a first end projecting from a first side of the support for coupling with an end of a coil of the coil component, and a second end projecting from a second side of the support for coupling with an external circuit on a printed circuit board; said first end being integrated with said second end through an intermediate portion which is molded in said support; line ($L_1$) connecting the top of the second ends on a second side of the support being parallel to a second line ($L_2$) the connecting top of the second ends on an opposing second side; the second ends of said terminal pins projecting from the second sides of the support wherein said second sides are perpendicular to the first sides; a magnetic core fixed on said support having said coil; housing means covering said magnetic core having at least essentially a rectangular bottom portion with pairs of linear parallel outer walls; and each of said outer walls extending beyond said first ends of said terminal pins.

BRIEF DESCRIPTION OF THE DRAWINGS

The foregoing and other objects, features, and attendant advantages of the present invention will be appreciated as the same and become better understood by means of the following description and drawings wherein.

DESCRIPTION OF THE PREFERRED EMBODIMENTS

The embodiment of the present invention is described in accordance with FIGS. 1 through 4 for a transformer for a DC—DC converter.

Figure 3A:
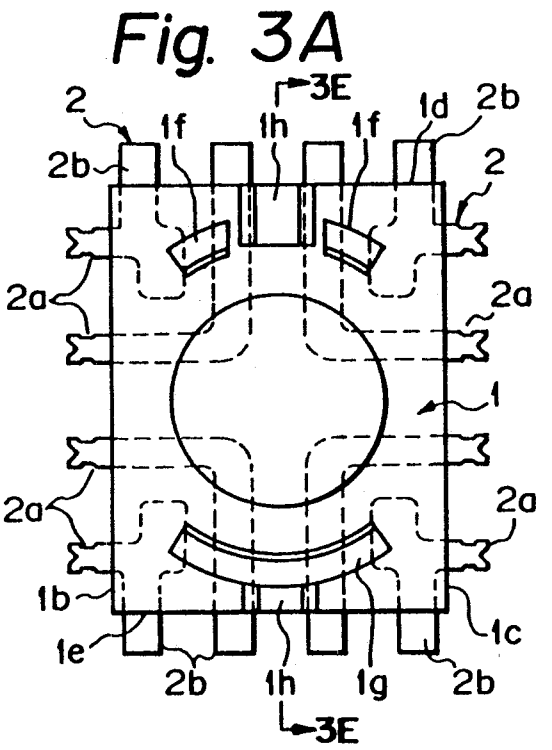
FIG. 3A is a plan view of a support of the coil component of FIG. 1A.
Figure 3B:
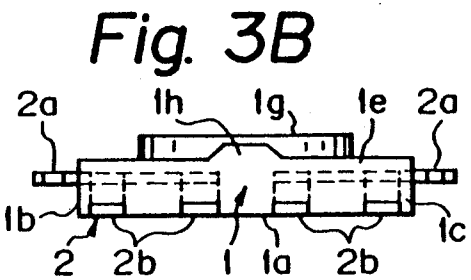
FIG. 3B is a side view of the support of the coil component of FIG. 1A.

As shown in FIGS. 3A and 3B, a plurality of conductive terminal pins 2 are molded into a rectangular support 1, which is made of dielectric plastic. The terminal pins 2 are constituted in a lead frame, which is molded with the support 1; then, the outer frame of the lead frame is cut away to provide the molded support and the terminal pins.

Figure 3C:
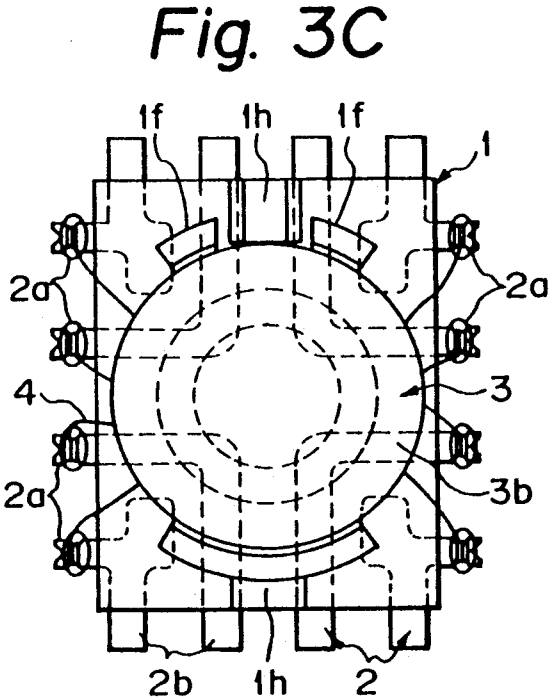
FIG. 3C is a plan view of the support which mounts a drum core.
Figure 3D:
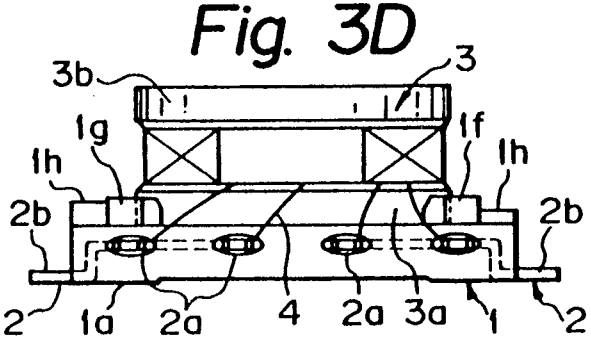
FIG. 3D is a side view of FIG. 3C.
Figure 3E:
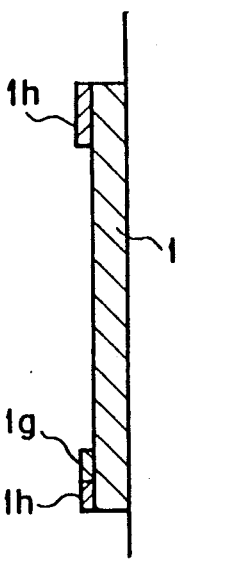
FIG. 3E shows a cross section taken along line 3E–3E of FIG. 3A.

Referring to FIG. 3C and 3D, each of the terminal pins 2 has a first end **2*a*, which is connected to an end of a coil 4 wound on a drum core 3 made of ferrite material, and a second end 2*b*, which is to be connected to a printed circuit board (not shown) through soldering. The intermediate portion of each terminal pin 2 between the first end 2*a* and the second end 2*b* located within the support 1**.

The drum core 3 has a pair of circular flanges **3*a* and 3*b*, which are connected by an intermediate column. A coil is wound on the intermediate column, and ends of the coil are connected to the first ends 2*a* of the terminal pins 2**.

The second ends 2*b* of the terminal pins are in the plane defined by the bottom surface 1*a* of the support 1 so that said second ends 2*b* and said bottom surface 1*a* contact with the surface of a printed circuit board which mounts the coil component. The first ends 2*a* are located higher than said plane so that there exists some spacing between said first ends 2*a* and the surface of the printed circuit board. Thus, the intermediate portion of each terminal pin is offset or curved in the support 1 so that the first end 2*a* is located higher than the second end 2*b*.

The first ends 2*a* project from a side 1*b* or a side 1*c* of the support 1, and the second ends 2*b* project from a side 1*d* or a side 1*e*. The sides 1*b* and 1*c* are parallel to each other, the sides 1*d* and 1*e* are parallel to each other; and the sides 1*b* and 1*c* are perpendicular to the sides 1*d* and 1*e*.

A line $L_1$ (see FIG. 1B), connecting the outer most surfaces of the second ends 2*b* of terminal pins 2 along the side 1*d*, is parallel to a line $L_2$, connecting the outermost surfaces of the second ends 2*b* of terminal pins 2 along the side 1*e*. It should be appreciated that the second ends 2*b* are not soldered when the coil component is mounted on a printed circuit board. Therefore, the lines $L_1$ and $L_2$ are precisely linear and can be used as reference lines for locating the coil component by using an automatic mounting machine.

The support 1 has a plurality of arc-shaped projections 1*f* and 1*g*. (See FIGS. 2*a*–2*c*) The inner arcs of those projections engage with a bottom flange 3*a* of a drum core 3 for locating the core 3. The outer arcs of those projections engage with an inner surface of a ring-shaped housing, which may be either a core 5 or a dielectric housing. The support 1 has also a pair of tapered projections 1*h*, which are engaged with the ring-shaped housing 5. The housing 5 is located by said arc-shaped projections, 1*f* and 1*g* and said tapered projections 1*h*.

Figure 4B:
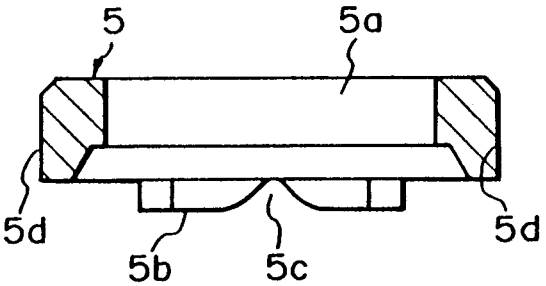
FIG. 4B is a cross section taken along line of 4B–4B of FIG. 4A.
Figure 4A:
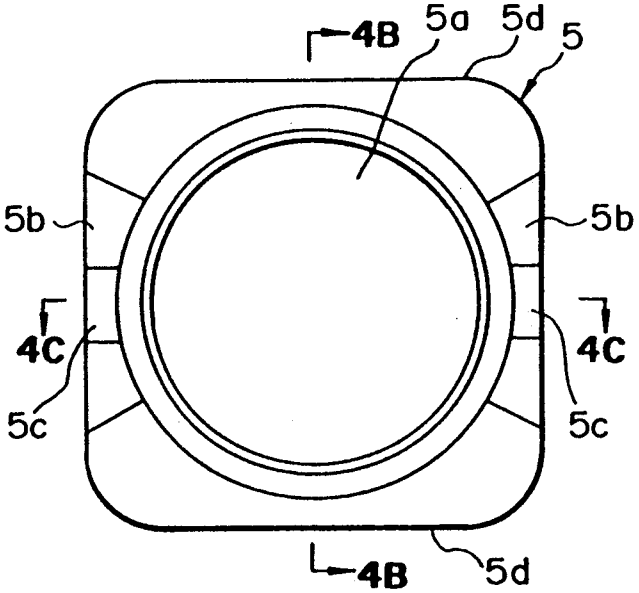
FIG. 4A is a bottom view of a housing means of the coil component of FIG. 1A.
Figure 4C:
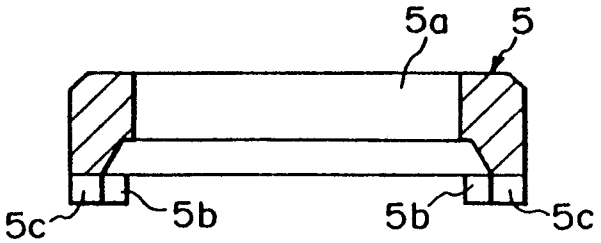
FIG. 4C is a cross section taken along line of 4C–4C of FIG. 4A.

The core of housing 5, as shown in FIG. 4, has an essentially rectangular external appearance and a hollow cylindrical circular center hole 5*a*, which receives the drum core 3 together with a coil 4. The housing 5 also has the pair of projections 5*b* at the bottom of the housing 5, along opposing sides of the housing 5, for positioning the housing 5 itself. A V-shaped recess 5*c* is provided between a pair of projections 5*b*, so that said recess 5*c* engages with the related projection 1*f* on the support 1, and the housing 5 is positioned by said projection 1*f*.

The opposing sides 5*d*, 5*d* of the housing 5, relating to the first ends 2*a* of the terminal pins 2, are parallel to each other. Further, sides 5*d* are parallel to the lines $L_1$ and $L_2$ which connect the ends of the second ends 2*b*, as shown in FIG. 1B. Sides 5*d*, 5*d* and lines $L_1$ and $L_2$ are pushed by adjusting chips of an automatic mounting machine for positioning the coil component.

As shown in FIGS. 1 and 2, the bottom flange 3*a* of the drum core 3 is adhered to the support 1 in the position dictated by arc-shaped projections 1*f* and 1*g*. It is supposed, of course, that the drum core 3 has a coil 4. Ends of the coil 4 are coupled with the first ends 2*a* of the terminal pins 2 through soldering. The housing 5 receives in the center hole 5*a*, the drum core 3. The recess 5*c*, at the bottom of the housing 5, is engaged with the projection 1*h* of the support 1. The projection 5*b* of the housing 5 is engaged with the arc-shaped projections 1*f* and 1*g* on the support 1. Adhesive is used for fixing the housing 5 on the support 1.

Figure 1A:
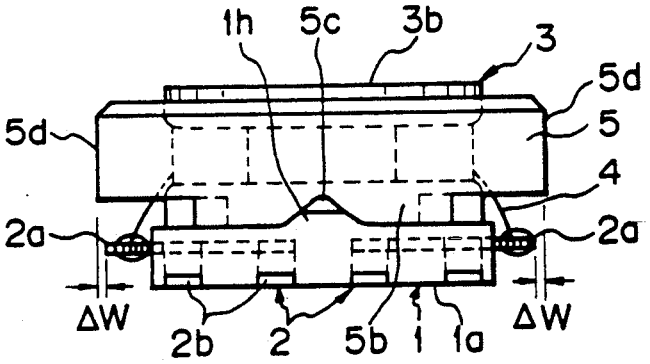
FIG. 1A is a first side view of a coil component according to the present invention.
Figure 1B:
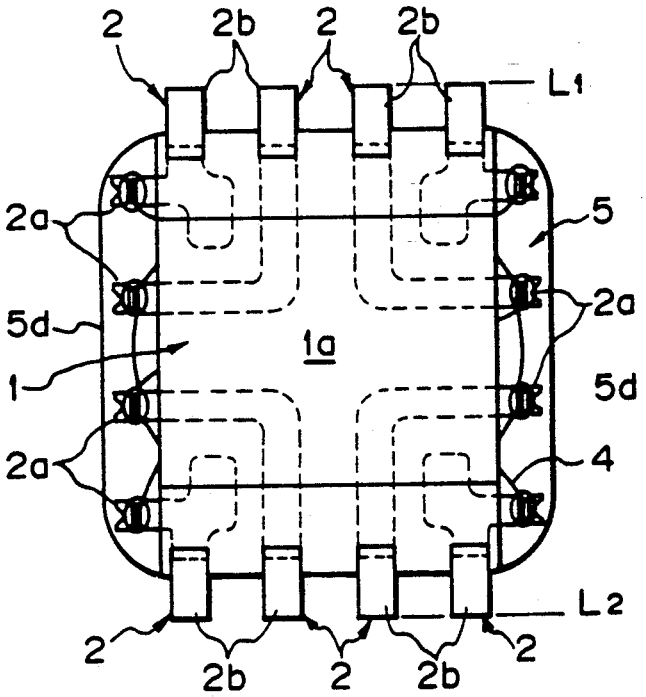
FIG. 1B is a bottom view of the coil component of FIG. 1A.
Figure 2A:
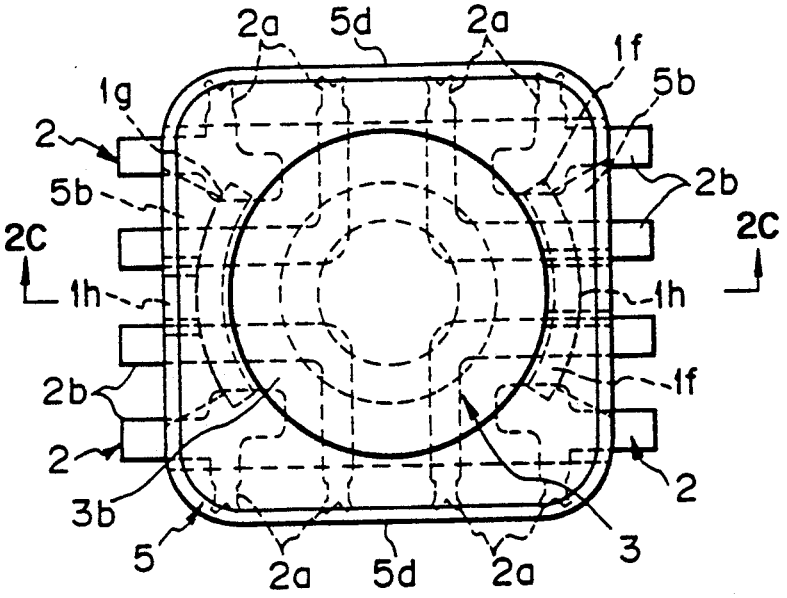
FIG. 2A is a top view of the coil component of FIG. 1A.
Figure 2B:
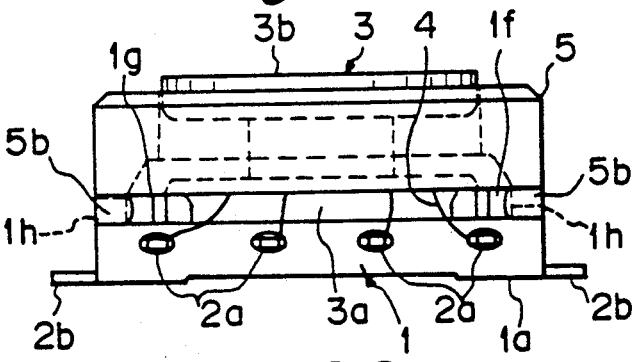
FIG. 2B is a second side view of the coil component of FIG. 1A.
Figure 2C:
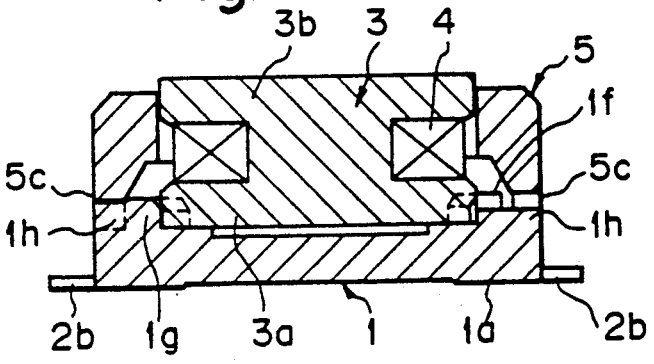
FIG. 2C is a cross section taken along line 2C–2C of FIG. 2A.

When the coil component is assembled as described above, the outer walls 5*d* of the housing 5 extend farther outward than the tops of the first ends 2*a* of the terminal pins 2 by the length ΔW (see FIG. 1A). One embodiment of the numerical value of ΔW is 0.2 mm. In other words, the width of the coil component is defined by the size of the housing, but not by the terminal pins.

Figure 5A:
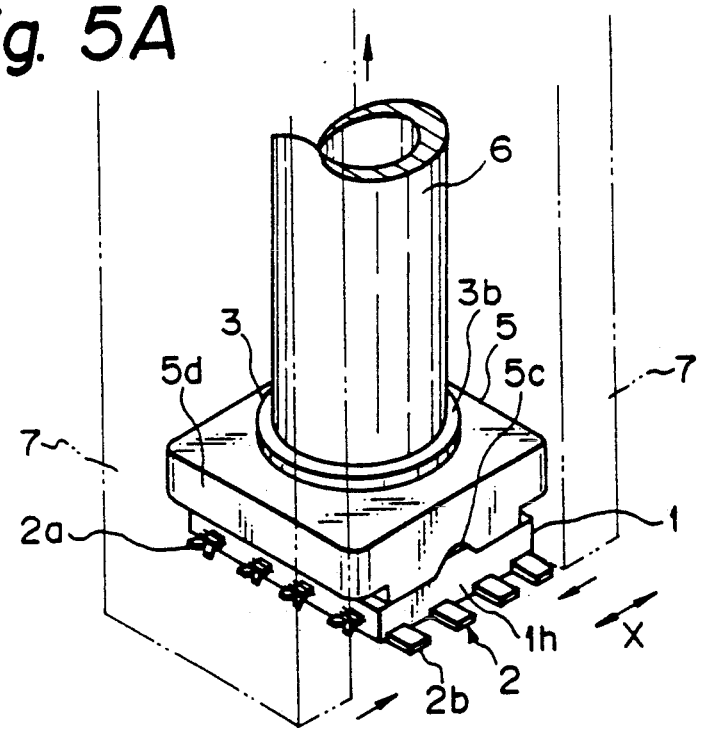
FIG. 5A and 5B show perspective views of an adjusting chip of an automatic mounting machine.

When the present coil component is mounted on a printed circuit board (not shown), a vacuum nozzle 6 (see FIG. 5A) of an automatic mounting machine picks up a coil component with an upper flange 3*a* of drum core 3. A pair of adjusting chips 7 of the automatic mounting machine adjust the location of the coil component by pushing one of the outer walls 5*d* of the housing 5 of the coil component with one of the chips 7. In this case, it should be appreciated that a first end 2*a* of a terminal pin is not pushed, as it is located behind the outer wall 5*d* of a housing of a coil component. FIG. 5A shows the adjustment of the location of the coil component in the X-direction and/or the angle adjustment around the center of the nozzle 6.

Figure 5B:
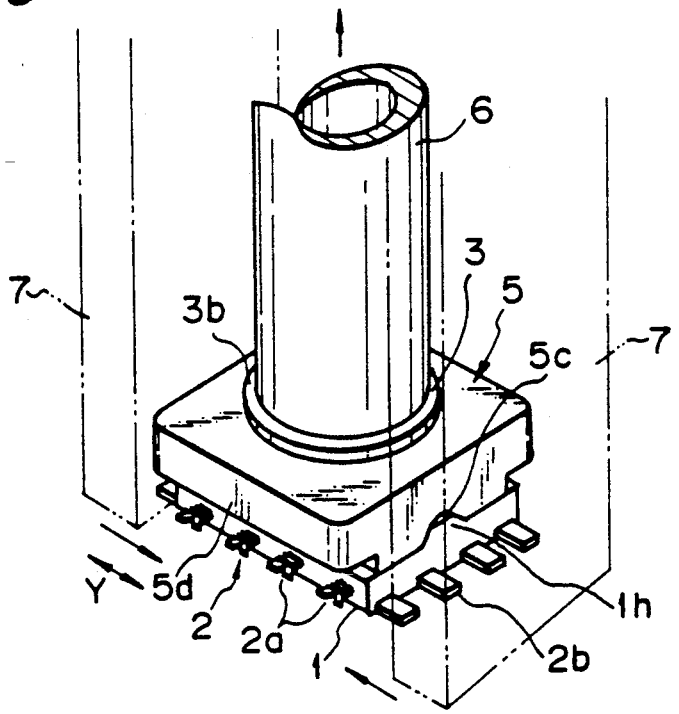

When the adjustment in the X-direction is finished, the adjusting chips 7 are opened and rotated by 90° around the center of the nozzle 6. Then, the adjustment in the Y-direction is carried out as shown in FIG. 5B, by pushing the tops of the second ends 2*b*, which are aligned along the line $L_1$ or $L_2$. It should be noted that the lines $L_1$ and $L_2$ are accurate linear lines as those lines are determined by cutting an outer frame of a lead frame. Alternatively, when a housing is large (for instance when the height of a housing is higher than 5 mm), outer walls of a housing may be used as a reference for positioning a coil component. In this case, an adjusting chip 7 would not push the tops of second ends 2*b* of terminal pins 2.

Figure 6:
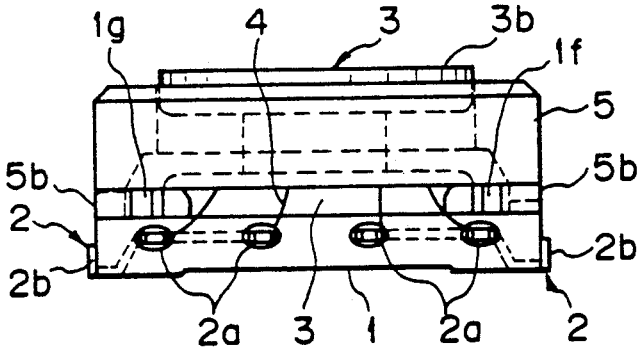
FIG. 6 is a side view of another embodiment of the coil component according to the present invention.

FIG. 6 shows a modification of the present coil component. The feature of FIG. 6 is that the second end 2*b* of each terminal pin 2 is folded along a side wall of a support 1. In that structure, a coil component is accurately positioned on a printed circuit board even when second ends 2*b* of terminal pins 2 are somewhat deformed during assembling process.

When a coil component is positioned on a printed circuit board, second ends 2*b* of terminal pins 2 are soldered with conductive patterns on a printed circuit board for external connection.

It should be appreciated, of course, that some modifications are obvious to those ordinarily skilled in the art. For instance, a bottom of a housing is not restricted to a rectangular shape, but it is enough as far as it has a pair of parallel linear sides which cover first ends 2*a* of terminal pins 2 which are dipped into melted solder.

As described above, according to the present invention, a coil component is precisely and correctly positioned on a printed circuit board by using an automatic mounting machine, in spite of soldering of the terminal pins.

From the foregoing it will now be apparent that a new and improved coil component has been found. It should be understood, of course, that the embodiments disclosed are merely illustrative and are not intended to limit the scope of the invention. Reference should be made to the appended claims, therefore, rather than the specification as indicating the scope of the invention.

What is claimed is:

1. A coil component comprising:

a dielectric support (1) mounting a magnetic core (3) which has a coil, said support (1) having a plurality of conductive terminal pins (2) projecting from sides of said support (1), each of said terminal pins (2) having a first end (2*a*) projecting from one of the sides of the support (1) for coupling with an end of said coil of the coil component, and a second end (2*b*) projecting from another one of the sides of the support (1) for coupling with an external circuit on a printed circuit board, said first end (2*a*) of each terminal pin being integral with said second end (2*b*) thereof through an intermediate portion which is molded in said support (1), top edges of the second ends (2*b*) of the terminal pins along respective sides of said support being aligned with each other in parallel straight lines ($L_1$, $L_2$), said aligned top edges of said second ends (2*b*) of said terminal pins (2) being perpendicular to said sides from which said first ends project, and housing means (5) covering said magnetic core (3) having at least an essentially rectangular bottom portion with pairs of linear parallel outer walls (5*d*), a pair of said outer walls (5*d*) of said housing means (5) extending beyond top edges of said first ends (2*a*) of said terminal pins.

2. A coil component according to claim 1, wherein said housing means is a ring-shaped magnetic core.

3. A coil component according to claim 1, wherein said housing means is dielectric.

4. A coil component according to claim 1, wherein said support has a pair of projections, which engage with recesses on a rectangular bottom portion of the housing means for locating the housing means on the support.

5. A coil component according to claim 1, wherein ends of the second ends (2*b*) of the terminal pins (2) are folded along a side wall of said support (1).

6. A coil component according to claim 1, wherein said support is molded on terminal pins (2).

7. A coil component according to claim 1, wherein said first ends of the terminal pins are soldered with ends of the coil by dipping said first ends into melted solder.

8. A coil component according to claim 1, wherein said second ends of said terminal pins are located in a plane defined by a bottom plane of said support, and said first ends of said terminal pins are located with some spacing from said plane.

9. A coil component according to claim 8, wherein an intermediate portion connecting said first end and said second end is offset to provide said spacing.

10. A coil component according to claim 8, wherein an intermediate portion connecting said first end and said second end is curved to provide said spacing.

* * * * *